United States Patent [19]

Waugh

[11] Patent Number: 4,778,993

[45] Date of Patent: Oct. 18, 1988

[54] TIME-OF-FLIGHT MASS SPECTROMETRY

[75] Inventor: Allen R. Waugh, East Grinstead, England

[73] Assignee: VG Instruments Group Limited, Crawley, England

[21] Appl. No.: 90,379

[22] Filed: Aug. 28, 1987

[30] Foreign Application Priority Data

Oct. 31, 1986 [GB] United Kingdom ..... 8626075

[51] Int. Cl.[4] ..... H01J 41/40

[52] U.S. Cl. ..... 250/287; 250/282; 250/288; 250/309

[58] Field of Search ..... 250/287, 286, 288, 309, 250/282, 296

[56] References Cited

U.S. PATENT DOCUMENTS 4,633,083 12/1986 Knorr et al. ..... 250/287

OTHER PUBLICATIONS

Steffens et al., J. Vac. Sci. Technol. A, vol. 3, No. 3, May/Jun. 1985, pp. 1322–1325.

*Primary Examiner*—Bruce C. Anderson
*Assistant Examiner*—Jack I. Berman
*Attorney, Agent, or Firm*—Chilton, Alix and Van Kirk

[57] ABSTRACT

A method of time-of-flight mass spectrometry adapted for the analysis of ions up to a required mass limit comprises the following sequences of events:

(a) producing, during a first time interval, a pulse of charged particles, (b) directing said charged particles towards the entrance of a mass analyzer;

(c) recording the times-of-flight of said charged particles after they pass through said mass analyzer;

(d) closing a gating means, which is disposed in the path of said charged particles between said source and said mass analyzer, after a second time interval which, measured from the start of said first time interval, is sufficient for substantially all of said charged particles having mass less than or substantially equal to said mass limit to travel from said source to and through said gating means;

(e) keeping said gating means closed until the end of a third time interval which, measured from the start of said first time interval, is at least as long as the time taken for substantially the most massive of said charged particles to travel from said source to said gating means, and opening said gating means at substantially the end of said third time interval;

(f) repeating the procedure above, by producing another pulse after a fourth time interval measured from the start of said first time interval.

22 Claims, 2 Drawing Sheets

TIME-OF-FLIGHT MASS SPECTROMETRY

Figure 1:
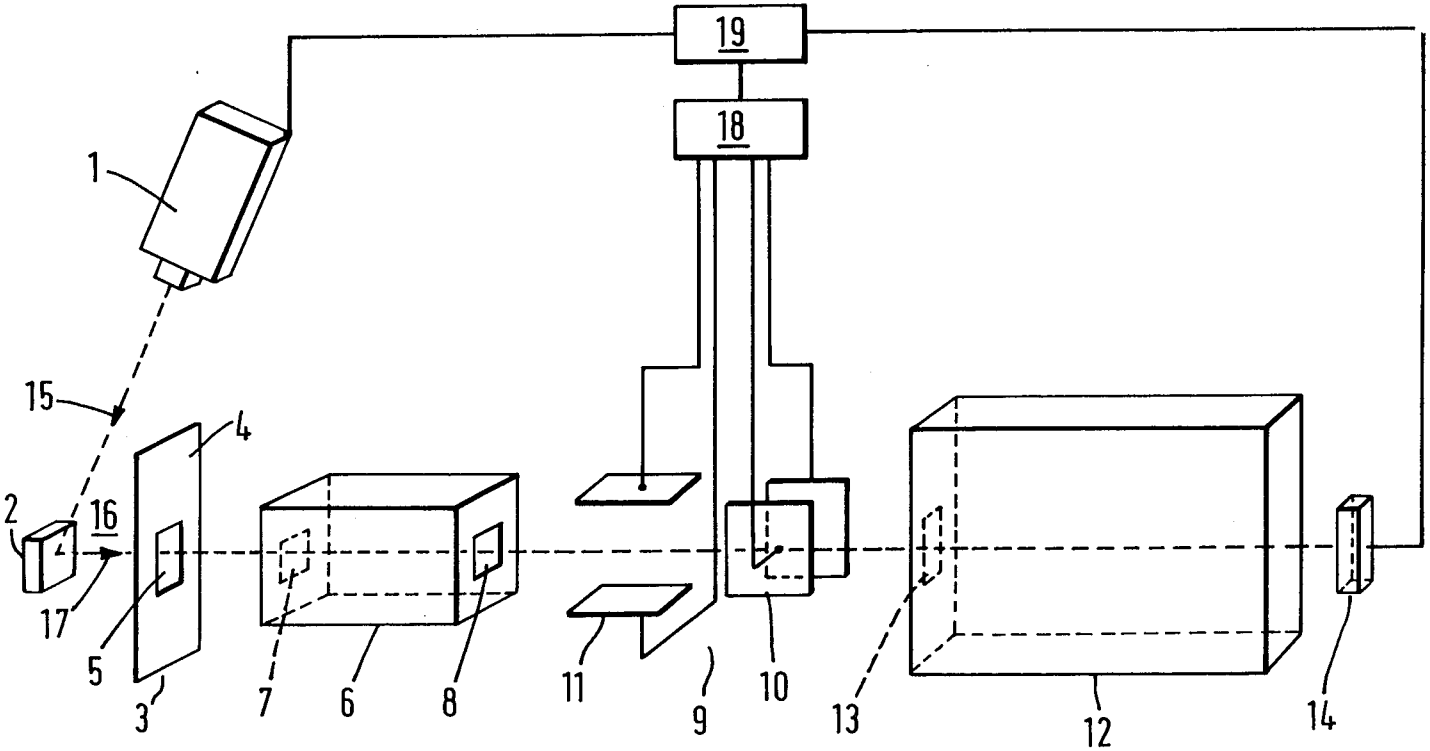

This invention relates to a method and apparatus for time-of-flight mass spectrometry, particularly though not exclusively adapted for use in secondary ion mass spectrometry to analyze the composition of surfaces.

In a time-of-flight mass spectrometer a mass spectrum is obtained by arranging that the time taken for each ion to travel a flight path depends upon its mass. Ions of equal kinetic energy travelling through a field-free region naturally disperse according to the square-root of their masses, though in practice it is desirable to compensate for an initial variation in kinetic energy. This variation may be overcome to an extent by applying a linear electric field which accelerates the ions according to their ratio of mass to charge, then the time of flight of each species of ion is a function of not only the the initial kinetic energy but also that imparted by the accelerating force. Time-of-flight mass spectrometers employing this technique have been described, for example by W. C. Wiley and I. H. McLaren in The Review of Scientific Instruments, volume 15(12), pp 1150–1157, 1955, and by B. T. Chait and K. G. Standing in The International Journal of Mass Spectromery and Ion Physics, volume 40, pp 185–193, 1981.

An improved design of time-of-flight mass spectrometer was described by W. P. Poschenreider in The International Journal of Mass Spectrometry and Ion Physics, volume 9, pp 357–373, 1972. This type of analyzer is known as 'energy-focussing' because, by the application of a toroidal electrostatic field, ions of equal mass to charge ratio travel equal flight times, those of higher energy travelling longer distances in the electrostatic field than those of lower energy. An alternative form of mass analyzer achieving 'momentum-focussing', by the application of a magnetic sector field, has also been described by W. P. Poschenrieder in The International Journal of Mass Spectrometry and Ion Physics, volume 6, pp 413–426, 1971.

A further design of energy-focussing, time-of-flight, mass spectrometer has been described by B. A. Mamyrin V. A. Karataev and D. M. Shmikk in British Patent Specification No. 1474149 and in U.S. Pat. No. 4,072,862, and by B. A. Mamyrin and D. M. Shmikk in Soviet Physics, JETP, volume 49(5), 1979, pages 762 to 765. In that instrument, which is known as the linear mass reflectron, the ions traverse a linear region and compensation for differing energies is achieved by reflecting the ions through 180° in a system of electrostatic fields.

In general, in time-of-flight mass spectrometry, regardless of the design of analyzer, the ions are provided for analysis in the form of a pulsed beam, each pulse containing the range of ion masses. The time of flight of each type of ion in a pulse is measured by electronic timing circuits from the time of creation of the pulse to the time of detection of the ion. Several methods of creating a pulsed beam of ions have been described, for example J. M. B. Bakker, in The Journal of Physics E, volume 7, 1974, pp 364–368 and J. D. Pinkston et al, in The Review of Scientific Instruments, volume 57(4), 1986, pp 583–592, describe systems which chop a continuous beam by deflecting the beam across a slit at the entrance to the flight region. Alternatively the ion beam may be created in pulses by a pulsed ionization process, e.g. by the impact of a pulsed primary ion beam.

One important application of time-of-flight analysis is in Secondary Ion Mass Spectrometry (SIMS), a technique developed for the analysis of the atomic and molecular composition of surfaces, in which a surface is bombarded by a beam of primary ions causing it to release characteristic secondary ions. The secondary ions are then collected and analysed using a time-of-flight or other form of mass analyzer, for example a magnetic-sector mass spectrometer. More generally, ions may be released from a surface by some other means, for example laser ionisation or electron impact and again a time-of-flight mass spectrometer may be used to identify the released ions and so analyse the composition of the surface. A review of analytical techniques using time-of-flight mass spectrometry has been published by Price et al in The International Journal of Mass Spectrometry and Ion Processes, volume 60, pp 61–81, 1984.

Time-of-flight apparatus designed for SIMS has been described by A. R. Waugh et al in Microbeam Analysis, San Francisco Press Inc., pp 82–84, 1986 and also by P. Steffens et al, in The Journal of Vacuum Science and Technology, volume 3(3), pp 1322–1325, 1985. Both these instruments comprise an energy-focussing analyzer of the type described by Poschenrieder in 1972. The pulsed beam of secondary ions is generated by applying a pulsed primary ion beam to the surface under analysis. However, a problem with time-of-flight SIMS instruments arises because whereas it would be advantageous to arrange that the pulse repetition rate corresponds to the flight-time of the most-massive ion of interest, ions of greater mass in each pulse must be allowed to clear the flight tube before the next pulse is admitted, otherwise consecutive pulses interfere. One solution to this problem would be to reject as many pulses as neccessary, after admitting one pulse, to allow the admitted pulse to fully pass through the analyzer. Methods of rejecting alternate pulses are described by Bakker and by Pinkston et al in the context of overcoming problems in shaping a chopped beam. But rejecting alternate pulses is not neccessary for pulse-shaping when the ions are created by pulsed ionization, and furthermore it is not a satisfactory solution for a SIMS instrument because rejecting half, or more, of the emitted secondary ions reduces the sensitivity of the instrument.

It is the object, therefore, of this invention to provide a method of time-of-flight, mass spectrometry in which interference with the analysis by ions of mass greater than the highest mass of interest is substantially eliminated, without adversely affecting the sensitivity of the analysis.

It is a further object of the invention to provide a time-of-flight, mass spectrometer in which interference with the analysis by ions of mass greater than the highest mass of interest is substantially eliminated, without adversely affecting the sensitivity of the spectrometer.

Thus according to one aspect of the invention there is provided a method of time-of-flight mass spectrometry adapted for the analysis of ions up to a required mass limit comprising the following sequence of events:

(a) producing from a source, during a first time interval, a pulse comprising charged particles which are distributed over a range of masses;

(b) extracting said charged particles from said source and directing them towards the entrance of a mass analyzer;

(c) recording the times-of-flight for those of said charged particles which reach a detector disposed in their path after they pass through said mass analyzer;

(d) closing a gating means, which is disposed in the path of said charged particles between said source and said mass analyzer, after a second time interval which, measured from the start of said first time interval, is sufficient for substantially all of said charged particles, produced during said first time interval and having mass less than or substantially equal to said mass limit, to travel from said source to and through said gating means;

(e) keeping said gating means closed until the end of a third time interval which, measured from the start of said first time interval, is at least as long as the time taken for substantially the most massive of said charged particles to travel from said source to and through said gating means, and opening said gating means at substantially the end of said third time interval;

(f) repeating the procedure described in (a) to (e) above, by first producing another pulse after a fourth time interval measured from the start of said first time interval.

In this way there is produced a sequence of pulses of charged particles, each created with pulse width equal to said first time interval, and the period of the sequence being equal to said fourth time interval.

According to another aspect of the invention there is provided a time-of-flight mass spectrometer adapted for the analysis of charged particles up to a required mass limit comprising:

(a) means for producing from a source, during a first time interval, a pulse comprising charged particles distributed over a range of masses;

(b) a preliminary mass separating means, having a first entrance and an exit, said charged particles travelling between said first entrance and exit in a time, which for each of said charged particles, is dependent upon the mass of that charged particle;

(c) a time-of-flight mass analyzer having a second entrance;

(d) extraction means, disposed between said source and said preliminary mass separating means, which accelerates said charged particles from said source towards said first entrance of said preliminary mass separating means;

(e) a gating means, disposed between said exit of said preliminary mass separating means and said second entrance of said time-of-flight mass analyzer;

(f) means for controlling said gating means adapted to (i) close said gating means after a second time interval which, measured from the start of said first time interval, is sufficient for substantially all of said charged particles, produced during said first time interval and having mass less than or substantially equal to said mass limit, to travel from said source, through said preliminary mass separating means, to and through said gating means; and (ii) keep said gating means closed until the end of a third time interval, which measured from the start of said first time interval is at least as long as the time taken for substantially the most massive of said charged particles to travel from said source to said gating means, and to open said gating means at substantially the end of said third time interval; and (g) means for producing a plurality of said pulses successively, the time between the start of one pulse and the start of the next pulse being equal to a fourth time interval.

In a preferred embodiment of the invention the preliminary mass separating means comprises a drift region, substantially free of electrostatic fields. In a further preferred embodiment the preliminary mass separating means comprises a region in which there is at least one electrostatic field. The preliminary mass separating means may comprise a toroidal electrostatic field having energy-focussing properties, or an electrostatic mirror having energy-focussing properties. The essential feature of the preliminary mass separating means is that it should separate the charged particles, by flight-times, according to their masses.

Preferably the gating means comprises deflector plates and is opened by applying voltages to the deflector plates which allow or deflect the charged particles into the entrance of the mass analyzer, and is closed by applying voltages to the plates which deflect charged particles away from the entrance of the mass analyzer. Conveniently, the gating means may be opened by earthing the deflector plates. Such deflector plates may be provided to give deflections in X and Y directions, orthogonal to the direction of travel of the charged particles before deflection, as commonly understood, and deflection voltages may be applied in one or both X and Y directions as convenient.

In a further preferred embodiment the gating means comprises a repeller grid, and may be closed by applying a repelling voltage to that grid, thereby repelling the charged particles away from the entrance of the mass analyzer; for example, a grid may be disposed across the entrance of the mass analyzer and a voltage applied to reflect the charged particles through substantially 180°. Alternatively the gating means may comprise at least one accelerating electrode, conveniently in the form of an accelerating grid, and may be closed by applying an accelerating voltage to accelerate the charged particles, still allowing them to proceed substantially towards the entrance of the mass analyzer, but giving them a kinetic energy outside pass energy band of the mass analyzer, thereby preventing the analysis of those charged particles having mass greater than the mass limit.

In a preferred embodiment of the invention the means for producing pulses of charged particles from a source comprises means for irradiating the surface of a sample with primary radiation, in which case the source comprises said surface and the charged particles are produced as a result of the interaction of the primary radiation with the surface.

Also in a preferred embodiment the primary radiation comprises a pulsed beam of primary ions, in which case the charged particles are secondary ions and the time-of-flight mass spectrometer of the invention is known as a time-of-flight, secondary ion mass spectrometer. Alternatively the primary radiation may comprise a pulsed beam of neutral atoms, electrons or laser radiation. The invention may also comprise means for ionising neutral particles released from the source, or more specifically from the surface, thereby producing during said first time interval a pulse of charged particles comprising ionised neutral particles.

The extraction means may conveniently comprise an extractor plate having an aperture through which the charged particles may pass. An electric extraction field is applied to accelerate the charged particles from the surface of the sample towards the extractor plate. The invention may be adapted to analyse particles of either positive or negative electric charge by the appropriate choice of the direction of the extraction field.

In the embodiments of the invention described above, in which the primary radiation comprises a pulsed beam of ions, neutral atoms, electrons or laser radiation, the extraction field is maintained with substantially constant magnitude and direction, the charged particles are then produced in pulses because the primary radiation beam is pulsed. Alternatively, the invention may comprise means for producing a substantially continuous beam of primary radiation, comprising ions, neutral atoms, electrons or laser radiation, and then the charged particles are produced in pulses by applying a pulsed electric extraction field.

In any embodiment in which a primary radiation beam, whether pulsed or continuous, is provided, means may also be provided to scan the primary radiation beam across the surface of the sample to perform a two-dimensional analysis.

In a further embodiment of the invention the means for producing pulses of charged particles comprises means for applying a pulsed electric field to a sample, causing the release of charged particles from its surface, a technique known as pulsed field desorption.

The time-of-flight mass analyzer of the invention may comprise at least one region substantially free of electric fields, or at least one region in which an electric field is maintained. Preferably the time-of-flight mass analyzer comprises an electrostatic, energy-focussing, time-of-flight analyzer. In a preferred embodiment of the invention the time-of-flight mass analyzer comprises an energy-focussing, toroidal electrostatic field. Alternatively the time-of-flight mass analyzer may comprise at least one energy-focussing, linear electrostatic field. In a further preferred embodiment the invention comprises a magnetic-sector, momentum-focussing time-of-flight analyzer.

The time at which the gating means is to be closed, the end of the second time interval, can be calculated from particle dynamics, because it corresponds to the flight time of the most massive charged particle of interest through the preliminary mass separating means. The time at which the gating means is re-opened, at the end of the third time interval, can similarly be calculated if the mass of the most massive charged particle is known. In practice, however, the most massive charged particle may not be known and the time intervals may have to be adjusted to eliminate the most massive charged particles from the mass spectrum. In the preferred embodiment of the invention, described in detail below, it is convenient to set the end of the third time interval at the time when the most massive charged particle of interest has been detected after passing through the mass analyzer; it is found that this ensures the elimination of the most massive charged particle which is not of interest, for most samples.

Also, it is preferable to allow a delay between the end of the third time interval and the start of the next pulse, at the end of the fourth time interval, to allow the voltages on the gating means to stabilise after opening the gating means.

Figure 2:
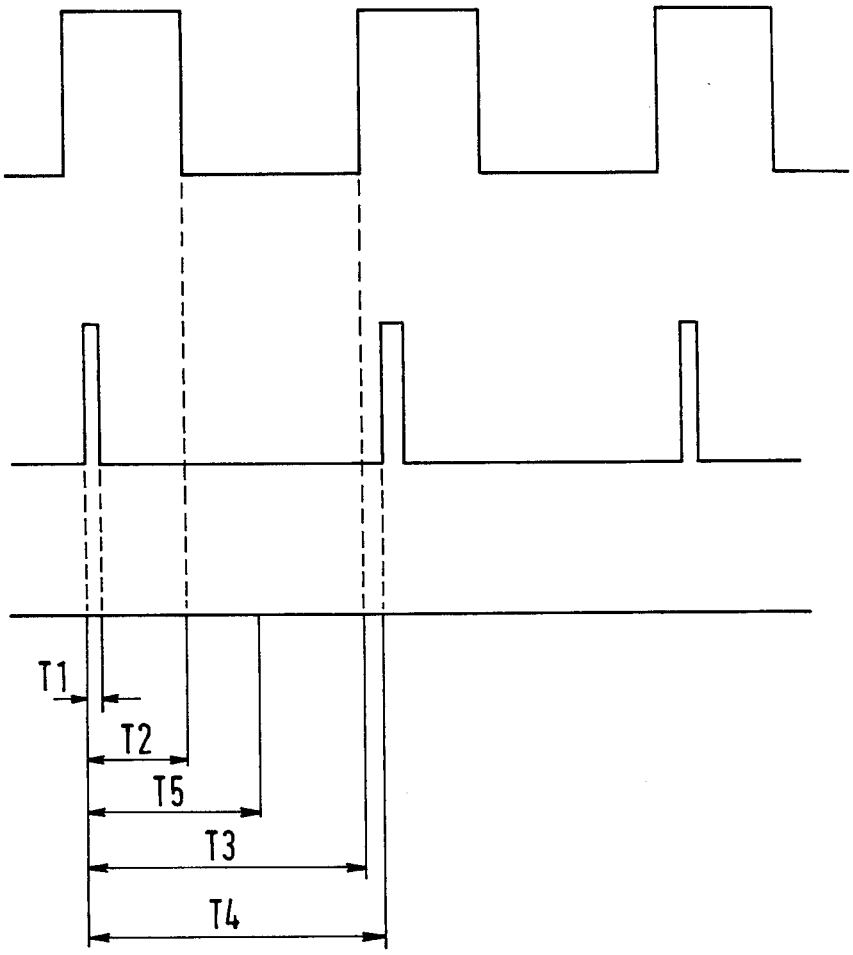

A preferred embodiment of the invention will now be described, by way of example, with reference to the figures in which:

FIG. 1 illustrates a time-of-flight secondary ion mass spectrometer according to the invention, incorporating an energy-focussing mass analyzer; and FIG. 2 shows the sequence of timing of events in the operation of the mass spectrometer of FIG. 1.

Referring first to FIG. 1, there is shown in schematic form a time-of-flight secondary ion mass spectrometer comprising:

(i) means for producing pulses of charged particles from a source, which comprises a primary ion gun 1, and a sample 2, in which sample 2 is the said source and the charged particles are secondary ions emitted from the surface of sample 2 under the action of primary ions from ion gun 1;
(ii) extraction means 3, comprising extractor plate 4, with aperture 5;
(iii) preliminary mass separating means 6, which is a drift region substantially free of electrostatic fields, having a first entrance 7 and an exit 8;
(iv) gating means 9 comprising X-deflector plate pair 10, and Y-deflector plate pair 11;
(v) time-of-flight mass analyzer 12, having second entrance 13; and
(vi) detector 14.

Ion gun 1 typically comprises a liquid metal ion source with means to focus and scan pulses of primary ions 15 across the surface of sample 2 to perform a two-dimensional analysis, if required, as known in the art.

Sample 2 is maintained at an electric potential of approximately +5kV or −5kV with respect to earthed extractor plate 4, thereby establishing an electrostatic field in extraction region 16. That electrostatic field accelerates the secondary ions in pulse 17, produced from the surface of sample 2, substantially in the direction of the entrance 13 of mass analyzer 12. The distance between sample 2 and extractor plate 4 is approximately 5 mm. The distance between extractor plate 4 and Y-deflector plate pair 11 is approximately 300 mm.

Time-of-flight mass analyzer 12 is an energy-focussing analyzer having a toroidal electrostatic field.

Also shown in FIG. 1 are deflector plate voltage supply 18 and the means to produce a plurality of pulses, timing unit 19. It will be appreciated that items 1 to 14 are enclosed within a conventional vacuum chamber and that there are power supplies and control units for items 1,3,12 and 14 not shown on FIG. 1.

Referring now to FIG. 2, there is shown a timing sequence for events in the operation of the spectrometer (the time intervals are not drawn to scale). $T_1$ is the time during which a pulse of secondary ions 17 (FIG. 1) is emitted from sample 2, i.e. $T_1$ is the initial width of pulse 17 before dispersion. $T_4$ is the period of the cycle of pulses. $T_2$ is the time taken by the slowest ion of interest in pulse 17 to travel from sample 2 to gating means 9. $T_5$ is the time taken by the slowest ion in pulse 17 to reach gating means 9. $T_3$ follows $T_5$ and is the time after the start of $T_1$ when the gating means is reopened.

The method of operating the invention is as follows:

A cycle in the operation of the mass spectrometer is started when timing unit 19 sends a signal to ion gun 1 causing it to emit a primary ion pulse 15, directed towards the surface of sample 2.

When primary ion pulse 15 strikes the surface of sample 2, a pulse of secondary ions 17 is emitted and is attracted towards extractor plate 4, passes through aperture 5, entrance 7, preliminary mass separating means 6, exit 8 and continues towards gating means 9. Until the end of time period $T_2$, ions within pulse 17 are allowed through gating means 9 to continue towards entrance 13, and to pass through mass analyzer 12 to reach detector 14. The time-of-flight between sample 2 and detector 14 can then be recorded for each detected ion, and a mass spectrum derived by conventional means. At the end of time $T_2$, in response to a signal from unit 19, voltage supply 18 changes the voltages on either or both of deflector plate pairs 10 and 11 to deflect any further ions away from entrance 13, thereby closing gating means 9. Gating means 9 is kept closed until the end of time interval $T_3$, and re-opened at the end of time interval $T_3$, the most massive of the ions in the pulse having reached the gating means, and been deflected, by the earlier time $T_5$. In the preferred embodiment it is convenient to reopen gating means 9, i.e. to set the end of time interval $T_3$, when the most massive ion of interest has been detected at detector 14, because it is found that this ensures that $T_3$ is longer than $T_5$, for most samples of interest. There is then a further delay between the end of time $T_3$ and the start of the next pulse from ion gun 1, this delay is approximately 10 μs and is sufficient to allow the voltages on the deflector plates to stabilise. The cycle is then repeated as necessary to collect sufficient data as required by the analysis.

In a typical analysis in which, for example, secondary ions up to 300 amu are of interest, the period of the cycles ($T_4$) is approximately 50 μs, i.e. a frequency of 20 kHz. Typically, the width of primary ion pulse 15 is in the range from 1 ns to 50 ns, and the initial width ($T_1$) of secondary ion pulse 17 is approximately equal to this.

By the method and apparatus described above a mass spectrum is obtained in which interference between consecutive pulses is substantially eliminated.

I claim:

1. A method of time-of-flight mass spectrometry adapted for the analysis of ions up to a required mass limit comprising the following sequence of events:

(a) producing from a source, during a first time interval, a pulse comprising charged particles which are distributed over a range of masses;

(b) extracting said charged particles from said source and directing them substantially towards the entrance of a mass analyzer;

(c) recording the times-of-flight for those of said charged particles which reach a detector disposed in their path after they pass through said mass analyzer;

(d) closing a gating means, which is disposed in the path of said charged particles between said source and said mass analyzer, after a second time interval which, measured from the start of said first time interval, is sufficient for substantially all of said charged particles, produced during said first time interval and having mass less than or substantially equal to said mass limit, to travel from said source to and through said gating means;

(e) keeping said gating means closed until the end of a third time interval which, measured from the start of said first time interval, is at least as long as the time taken for substantially the most massive of said charged particles to travel from said source to said gating means, and opening said gating means at substantially the end of said third time interval;

(f) repeating the procedure described in (a) to (e) above, by first producing another pulse after a fourth time interval measured from the start of said first time interval.

2. A method as claimed in claim 1 comprising: closing said gating means by deflecting said charged particles away from said entrance of said mass analyzer; and opening said gating means by allowing said charged particles to travel substantially towards said entrance of said mass analyzer.

3. A method as claimed in claim 1 comprising: closing said gating means by deflecting said charged particles away from said entrance of said mass analyzer; and opening said gating means by deflecting said charged particles substantially towards said entrance of said mass analyzer.

4. A method as claimed in claim 1 in which the end of said third time interval is when the most massive charged particle of interest, being of mass substantially equal to said mass limit, is recorded at said detector.

5. A time-of-flight mass spectrometer adapted for the analysis of charged particles up to a required mass limit comprising:

(a) means for producing from a source, during a first time interval, a pulse comprising charged particles distributed over a range of masses;

(b) a preliminary mass separating means, having a first entrance and an exit, said charged particles travelling between said first entrance and exit in a time, which for each of said charged particles, is dependent upon the mass of that charged particle;

(c) a time-of-flight mass analyzer having a second entrance;

(d) extraction means, disposed between said source and said preliminary mass separating means, which accelerates said charged particles from said source towards said first entrance of said preliminary mass separating means;

(e) a gating means, disposed between said exit of said preliminary mass separating means and said second entrance of said time-of-flight mass analyzer;

(f) means for controlling said gating means adapted to (i) close said gating means after a second time interval which, measured from the start of said first time interval, is sufficient for substantially all of said charged particles, produced during said first time interval and having mass less than or substantially equal to said mass limit, to travel from said source, through said preliminary mass separating means, to and through said gating means; and (ii) keep said gating means closed until the end of a third time interval, which measured from the start of said first time interval is at least as long as the time taken for substantially the most massive of said charged particles to travel from said source to said gating means, and to open said gating means at substantially the end of said third time interval; and (g) means for producing a plurality of said pulses successively, the time between the start of one pulse and the start of the next pulse being equal to a fourth time interval.

6. A spectrometer as claimed in claim 5 wherein said preliminary mass separating means comprises a drift region, substantially free of electrostatic fields.

7. A spectrometer as claimed in claim 5 wherein said preliminary mass separating means comprises a region in which there is at least one electrostatic field.

8. A spectrometer as claimed in claim 5 wherein said gating means comprises deflector plates and is opened by applying voltages to said deflector plates which allow said charged particles into said second entrance, of said mass analyzer, and is closed by applying voltages to said deflector plates which deflect charged particles away from said second entrance of said mass analyzer.

9. A spectrometer as claimed in claim 8 wherein said gating means is opened by earthing said deflector plates.

10. A spectrometer as claimed in claim 5 wherein said gating means comprises a repeller grid and may be closed by applying a repelling voltage to said repeller grid, thereby repelling said charged particles away from said second entrance of said mass analyzer.

11. A spectrometer as claimed in claim 5 wherein said gating means comprises at least one accelerating electrode, and may be closed by applying an accelerating voltage to accelerate said charged particles, giving them a kinetic energy outside the pass energy band of said mass analyzer.

12. A spectrometer as claimed in claim 5 wherein said extraction means provides a pulsed extraction field.

13. A spectrometer as claimed in claim 5 comprising means for irradiating said source with a pulsed beam of primary radiation.

14. A spectrometer as claimed in claim 5 wherein said source is a sample, having a surface; said spectrometer also comprising means for irradiating said surface with a pulsed beam of primary laser radiation, producing from said surface a pulsed beam of charged particles comprising, during said first time interval, said pulse of charged particles.

15. A spectrometer as claimed in claim 5 wherein said source is a sample, having a surface; said spectrometer also comprising means for irradiating said surface with a pulsed beam of primary ions, producing from said surface a pulsed beam of secondary charged particles, comprising, during said first time interval, said pulse of charged particles comprising secondary ions.

16. A spectrometer as claimed in claim 5 wherein said source is a sample, having a surface; said spectrometer also comprising means for ionizing neutral particles released from said surface, thereby producing during said first time interval said pulse of charged particles comprising ionized neutral particles.

17. A time-of-flight secondary ion mass spectrometer, adapted for the analysis of secondary ions up to a required mass limit and comprising: a sample having a surface, means for irradiating said surface with a pulsed primary radiation beam, causing said secondary ions to be emitted from said surface in pulses, means for extracting said secondary ions from said surface, a mass analyzer having an entrance, and a secondary ion detector; wherein the time during which one of said pulses of secondary ions is emitted from said surface is to be known as the first time interval; and also wherein said spectrometer is characterised by also comprising a preliminary mass separating means, deflector plates disposed between said preliminary mass separating means and said mass analyzer, and means for applying deflecting voltages to said deflector plates thereby, for each of said pulses to:

(i) deflect said secondary ions away from said entrance of said mass analyzer after a second time interval which, measured from the start of said first time interval, is sufficient for substantially all of said secondary ions, produced during said first time interval and having mass less than or substantially equal to said mass limit, to travel from said surface, through said preliminary mass separating means, to and past said deflector plates, and to enter said mass analyzer; and to (ii) maintain said deflecting voltages on said deflector plates until the end of a third time interval, which measured from the start of said first time interval is at least as long as the time taken for substantially the most massive of said secondary ions to travel from said surface to said deflector plates, and to remove said deflecting voltages from said deflector plates at substantially the end of said third time interval; and wherein the time between the start of one pulse and the start of the next pulse of said secondary ions is equal to a fourth time interval.

18. A time-of-flight secondary ion mass spectrometer as claimed in claim 17 in which said end of said third time interval is when the most massive secondary ion of interest, being of mass substantially equal to said mass limit, has been detected, at said secondary ion detector, after passing through said mass analyzer.

19. A time-of-flight secondary ion mass spectrometer as claimed in claim 17 in which said preliminary mass separating means comprises a drift region substantially free of electric fields and substantially free of magnetic fields.

20. A time-of-flight secondary ion mass spectrometer as claimed in claim 17 wherein said pulsed primary radiation beam is a pulsed primary ion beam.

21. A time-of-flight secondary ion mass spectrometer, as claimed in claim 17 wherein said pulsed primary radiation beam is a pulsed primary laser beam.

22. A time-of-flight secondary ion mass spectrometer as claimed in claim 17 wherein said mass analyzer is an energy-focussing mass analyzer.

* * * * *